US009156591B2

(12) United States Patent
Böckmann et al.

(10) Patent No.: US 9,156,591 B2
(45) Date of Patent: Oct. 13, 2015

(54) PACKAGING CONTAINER THAT CAN BE VENTILATED

(71) Applicant: NORDFOLIEN GMBH, Steinfeld (DE)

(72) Inventors: Olaf Böckmann, Holdorf (DE); Sven Brinkmann, Dinklage (DE)

(73) Assignee: Nordfolien GMBH, Steinfeld (DE)

( * ) Notice: Subject to any disclaimer, the term of this patent is extended or adjusted under 35 U.S.C. 154(b) by 0 days.

(21) Appl. No.: 14/349,753

(22) PCT Filed: Oct. 8, 2012

(86) PCT No.: PCT/DE2012/000981

§ 371 (c)(1),
(2) Date: Apr. 4, 2014

(87) PCT Pub. No.: WO2013/050025

PCT Pub. Date: Apr. 11, 2013

(65) Prior Publication Data

US 2014/0241649 A1 Aug. 28, 2014

(30) Foreign Application Priority Data

Oct. 6, 2011 (DE) ..... 20 2011 106 386 U

(51) Int. Cl.
*B65D 33/01* (2006.01)

(52) U.S. Cl.
CPC ..... *B65D 33/01* (2013.01)

(58) Field of Classification Search
CPC ..... B65D 33/01; B65D 2205/02
USPC ..... 383/100–103
See application file for complete search history.

(56) References Cited

U.S. PATENT DOCUMENTS 5,553,942 A * 9/1996 Domke et al. ..... 383/101
5,902,046 A * 5/1999 Shibata ..... 383/107

(Continued)

FOREIGN PATENT DOCUMENTS

DE 10 2006 017229 A1 10/2007
DE 10 2007 022400 A1 11/2007
DE 10 2006 020303 U1 3/2008
DE 202012006946 U1 * 10/2012

*Primary Examiner* — Jes F Pascua
(74) *Attorney, Agent, or Firm* — Muncy, Geissler, Olds & Lowe, P.C.

(57) ABSTRACT

A particularly simple construction is intended for a packaging container for bulk material, in particular a sack or bag made of a plastic film with at least one container wall which encloses the bulk material, which comprises a multilayer venting region extending in the longitudinal direction of the container and consisting of at least one inner layer and one outer layer, wherein the venting region has at least one inner and outer opening, wherein the inner openings are designed as apertures in a strip-shaped surface region of the inner layer of the venting region, wherein the surface region extends over at least a portion of the direction of extent of the venting region, and wherein the at least one outer opening is formed in a joining seam laterally limiting the venting region, wherein a shielding element inside the venting region is associated with the outer opening in the joining seam for the deliberate diversion of at least a partial flow of the air flow passing through the venting region. This is achieved as a result of the venting region having just one chamber in which the shielding element separates the inner and outer openings from each other and the shielding element has a length that is between 10% and 50% of the overall length of the venting region.

7 Claims, 1 Drawing Sheet

(56) References Cited

U.S. PATENT DOCUMENTS 6,170,985 B1 * 1/2001 Shabram et al. ..... 383/100
7,090,398 B2 * 8/2006 Shibata ..... 383/101
2007/0267414 A1 * 11/2007 Ewerszumrode ..... 220/366.1
2009/0123094 A1 * 5/2009 Kreymborg et al. ..... 383/103

* cited by examiner

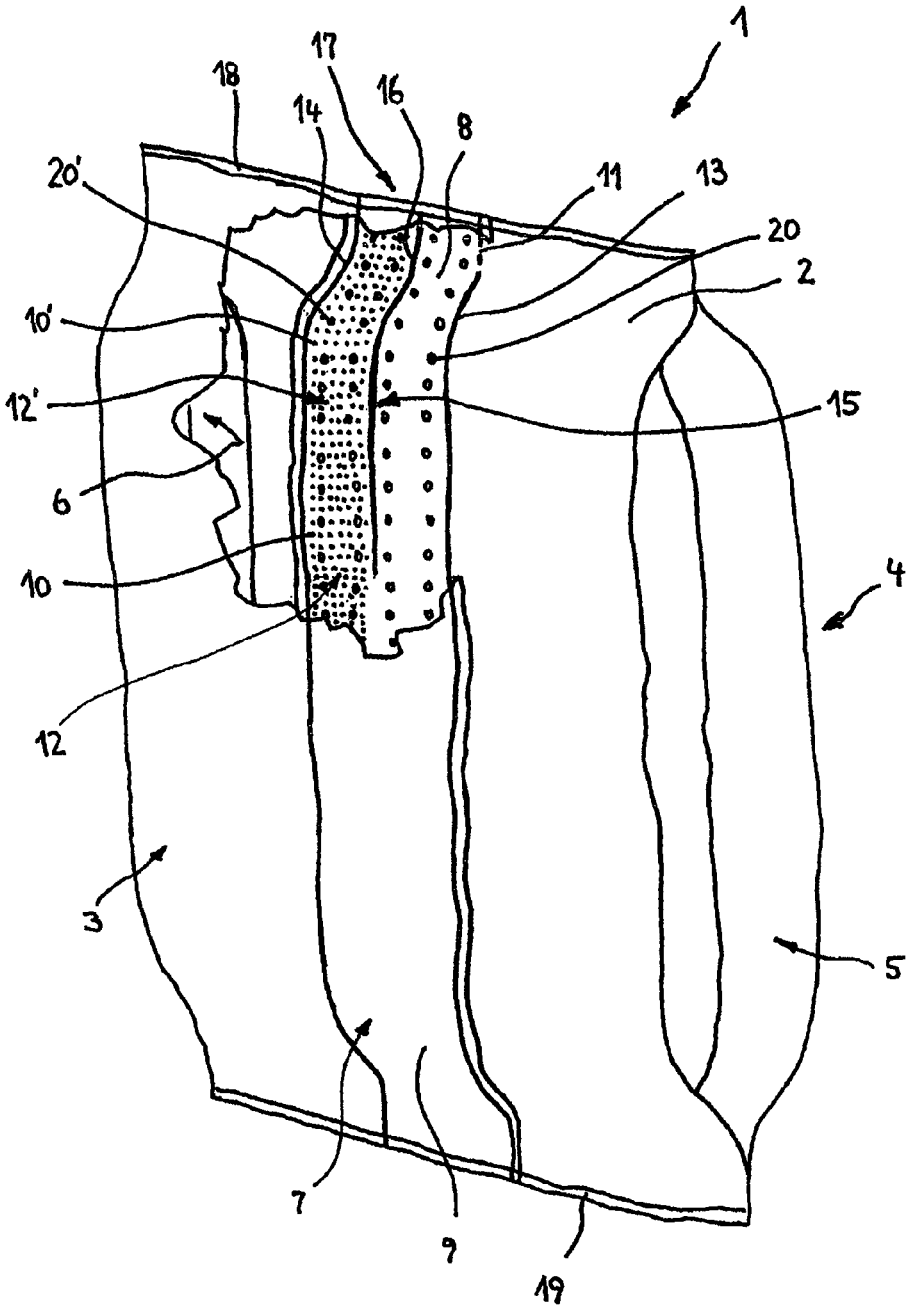
1
17
18
16
14
8
20'
11
13
20
2
10'
12'
15
6
10
4
12
3
5
7
9
19

PACKAGING CONTAINER THAT CAN BE VENTILATED

BACKGROUND OF THE INVENTION (1) Field of the Invention

The invention relates to a packaging container for bulk material, in particular a sack or bag made of plastic film, with at least one container wall enclosing the bulk material, which wall comprises a multilayer venting region extending in longitudinal direction of the container and consisting of at least one inner and one outer layer, wherein the venting region comprises at least one inner and one outer opening, wherein the inner openings are formed as apertures in a strip-shaped surface region of an inner layer of the venting region, wherein the surface region extends over at least one predetermined portion in the direction of extent of the venting region, and wherein at least one outer opening is formed in a joining seam laterally limiting the venting region wherein the outer opening in the joining seam inside the venting region has a shielding element associated with it for the deliberate diversion of at least a partial flow of the air flow passing through the venting region.

(2) Description of Related Art

It is known that packaging containers of the above mentioned kind are used for receiving pourable or free-flowing bulk materials such as for example foodstuffs, fertilizers and the like. Such pourable filling materials are a. o. manufactured in the food industry or the chemical industry or are required for further processing in a manufacturing process. The packaging containers are a means of transport for the filling materials or bulk materials, for their intermediate storage or for offering the end product contained in it for sale.

A generic packaging container is known from the DE 10 2007 022 400 A1. The venting device described herein comprises a venting channel with two separate chambers connected with each other via an overflow opening, wherein the inner venting opening is provided on the first chamber and the outer venting opening is provided on the second chamber.

The DE 20 2006 020 303 U1 describes a packaging container with walls, which form a through-passage for an air exit in a double-layer flat air exit region. The through-passage is divided into several chambers connected with each other by at least one passage, respectively, and where the inner openings and outer openings are arranged on the chambers at a distance from each other.

Another packaging container made from a flexible plastic film is known in particular from the DE 10 2004 013 469 A1, which is used for enclosing powder-like filling materials. The packaging container comprises at least one container wall enclosing the bulk material, which comprises a multilayer venting region extending in longitudinal direction of the container and consisting of at least one inner layer and one outer layer with only one chamber. In order to ensure that venting is possible from inside the container, for example, during the filling process, the venting region is provided with at least one inner and outer opening. The inner openings are primarily formed as apertures in a strip-shaped surface region of the inner layer of the venting region, so that air can flow from inside the container into between the inner and outer layer. The surface region provided with apertures roughly extends over the entire height of the venting region. An outer opening is provided in a joining seam laterally limiting the venting region, via which the air which has entered between the layers can be dissipated to atmosphere. This ensures safe venting, but in the case of relatively finely powdered filling materials it is possible that some of the filling material gets discharged from the packaging as early as during the filling process or immediately thereafter when the packaging container is subjected to a pressing operation.

BRIEF SUMMARY OF THE INVENTION

The invention is based on the requirement to improve a packaging container mentioned above in such a way as to construct the packaging container in an especially simple way, and the discharge of filling material via the venting region is kept to a minimum.

The solution to the requirement according to the invention is a packaging container with the characteristics disclosed herein. Advantageous further developments and designs of the invention are cited in the sub-claims.

With a packaging container for bulk materials, in particular a sack or bag made of plastic film, with at least one container wall enclosing the bulk material, which wall comprises a multilayer venting region extending in longitudinal direction of the container and consisting of at least one inner layer and one outer layer, wherein the venting region comprises at least one inner and outer opening, wherein the inner openings are formed as apertures in a strip-like surface region of the inner layer of the venting region and the surface region extends over at least a portion in the direction of extent of the venting region and wherein the at least one outer opening is formed in a joining seam laterally limiting the venting region and the outer opening in the joining seam inside the venting region is associated with a shielding element for the deliberate diversion of at least a partial flow of the air flow passing through the venting region, is provided that the venting region comprises only one chamber, in which the shielding element separates the inner and outer openings from each other and that the shielding element has a length in the region between 10% and 50% of the overall length of the venting region.

Due to forming the venting region with only one single chamber, in which a comparatively short shielding element is provided, the packaging container is substantially simplified especially in the venting region. Also according to the design of the venting region according to the invention the discharge of filling material is very small.

With the aid of the shielding element, which in particular separates the outer opening in the joining seam from the directly adjacently arranged apertures in the strip-shaped surface region of the inner layer, the air flow possibly laden with filling material particles is prevented from passing straight through, thereby avoiding any unwanted discharge of filling material particles. At the very least, the air flow passing through the inner layer in the surface regions adjacent to the outer opening is deliberately diverted so that this partial flow of the air flow passing through the venting region must travel along an advantageously extended venting path between inner opening and outer opening. Due to the extended venting path between the layers a large part of the filling material particles possibly drawn along in the air flow from the inside into the venting region is discarded from the air flow. The air passing through the outer opening therefore at least carries only a negligibly small amount of particles or at best no particles at all along with it. Further the use of a shielding element according to the invention permits an advantageously small construction of the venting region resulting in material savings. The strip-shaped surface region provided with inner openings may, for example, extend over the entire height of the venting region. The shielding element inside the venting region may, for example, be formed of a material portion of the plastic film used for manufacturing the packaging container, the material portion being fastened in longitudinal direction, on the inner and outer layer. A plastic film weldable on both sides or a plastic laminated film may be used as container wall. In addition the venting region of the packaging container can be produced by placing two longitudinal edges of a lengthwise folded film web on top of each other. It is also feasible, for a film tube produced by means of extrusion, to attach a film strip on the outside. The longitudinal edges of the film web or of the film strip attached to the film tube are connected, among others, by means of welded seams or glued seams.

According to a further development of the invention provision is made for the shielding element to be a seam portion, which separates the outer openings from a directly adjacently arranged surface portion of the strip-shaped surface region of the inner layer provided with apertures. The design as a seam portion represents an advantageously simple possibility for forming the shielding element, wherein the inner and outer layers of the venting region are directly connected with each other by means of the seam portion. This produces separate regions inside the one-chamber venting region. The strip-shaped surface region with its apertures in particular extends along one side of the seam portion. On the opposite side of the seam portion at least one outer opening is arranged in the joining seam, at a predetermined distance to the seam portion. It is also feasible to provide several outer openings in the respective joining seam, via which a correspondingly large air flow can escape.

Preferably the shielding element extends in longitudinal direction of the container and thus in parallel to the longitudinal sides of the lateral joining seams of the venting region also extending in longitudinal direction of the container. The parallel alignment of the shielding element with the longitudinal sides of the venting region in particular is responsible for creating regions identical in cross-section on both sides along the shielding element. The advantage of this is that an advantageously save venting function is ensured thus avoiding any bottleneck for the air flow passing through the venting region. It is feasible that the cross-sections on both sides of the shielding element are equally large. Possibly the region formed between outer opening and shielding element may be of smaller cross-section than the region along the other longitudinal side of the shielding element. The shielding element may, in relation to its position in the direction of extent of the venting region, be centrally arranged together with the outer opening. The outer opening may be approximately equally distanced from the ends of the shielding element. It is also feasible to provide the shielding element together with the outer opening at a random height of the venting region.

The shielding element and the outer opening are arranged in at least one end region of the venting region, wherein the shielding element directly ends at a transverse seam limiting the venting region. Forming the shielding element in an end region of the venting region has the advantage that specifically if forced venting by means of pressband is carried following the filling process and after closing the packaging container, the packaging container may be vented for a relatively long time without incurring an increased risk of damage such as the packaging container being torn open. The vented packaging container can then be optimally stacked for further transport. For example, it is possible that the shielding element is weakened across a section of its extension or has a weak point so that advantageously, in particular in case of subsequent venting, damage to the sack is excluded. With a shielding element formed as a separating seam, a weakening means such as a separating varnish may for example be provided over a section of the separating seam, which is partially applied between the inner and outer layer of the venting region thus weakening the connection. The connection of the separating seam is then separated or interrupted above a certain pressure in the venting region and the overpressure can reduce via the weak point and the outer opening. With a shielding element arranged in the end region of the venting region this weakening takes place in the vicinity of the transverse seam. But it is feasible for the weak point to be arranged anywhere else. The venting region may preferably extend across the entire height of the packaging container, so that the transverse seams closing the venting region simultaneously form the upper and lower closing seams of the packaging container.

The shielding element preferably formed as a seam portion is arranged directly adjacent and parallel to the associated surface portion of the strip-shaped region having the apertures. This is then used to divert the partial flow of the air flow entering the venting region through the apertures arranged adjacently to the shielding element initially directly in longitudinal direction of the venting region. At the free end of the shielding element the partial flow guided along the shielding element is diverted by approx. 180 degrees, wherein the partial flow is merged with at least a further partial flow, which has passed through surface portions of the inner layer which are not in the region of the shielding element. The further partial flow thus travels relatively straight in direction of the outer opening of the joining seam. Due to the relatively strong diversion of the one partial flow at the free end of the shielding element, the filling material particles carried along with it are, as a rule, automatically separated because of their mass inertia. In addition air turbulences are created by the diversion of the partial flow, which further improves the process of particle separation/removal. At the same time the filling material particles separating from the diverted partial flow meet with particles from the not diverted partial flow of the air flow passing through the venting region. This has the effect that the particles deflect each other with increased force and the air flow emerging at the outer opening is relatively free from particles.

The shielding element formed as or arranged inside the venting region preferably comprises a length of at least 5% of the overall height of the venting region. This ensures that the outer opening of the venting region is arranged sufficiently distant from the free end of the shielding element. Thus there is a sufficiently long path between the free end of the shielding element and the outer opening, in which the air flow can lose any remaining filling material particles still carried along.

In order not to unnecessarily hamper the venting function at the packaging container or even create an additional resistance for the air flow passing through the venting region, the shielding element is no longer than at most 60% of the overall height of the venting region. For a venting region extending in particular over the entire height of the packaging container the shielding element thus has a length of approx. 60% of the overall height of the packaging container. The preferred length of the shielding element lies within a range, in particular, between 10 and 50% of the height or length of the venting region.

Further, provision is made for the outer opening to be formed by means of an interruption of a lateral joining seam, wherein the superimposed layers of the venting region are connected with each other by means of the joining seam.

Interrupting the joining seam laterally limiting the venting region represents a constructionally simple possibility for forming the necessary outer opening. In this respect, with a joining seam produced in the regions envisaged for interruption by a process of welding, for example, the tool producing the weld is recessed so that the superimposed layers of the venting region remain unconnected. In particular several interruptions arranged at short distances from each other in the joining seam may be provided for forming the outer opening. Especially for a packaging container formed from a flat film web, where the venting region is produced by superimposing the edge regions of the film web, the interruptions are to be provided in the joining seam, which connects the rim edge of the upper of the superimposed longitudinal edges with the longitudinal edge beneath it.

Alternatively provision may be made as regards the interruptions of the joining seam for the outer opening to be formed by means of at least one weakened portion of the lateral joining seam. To this end a weakening means such as a separating varnish can be applied, prior to producing the venting region, to a surface portion associated with the outer opening, of at least one of the facing surfaces of the inner and outer layer of the venting region. As a consequence the superimposed layers in this surface portion provided with the weakening means form a distinctly weaker material bond with each other, when the continuous joining seam is formed. The material bond may be destroyed as early as when following filling, a packaging container completely closed by means of transverse welding seams, is guided through a pressband or squeezing band for squeezing out any air in the packaging container.

According to a further development provision is made for the multiplayer venting region to be equipped with distance pieces between at least one inner and one outer layer at least in partial regions. The escape of air from inside the packaging container, which had entered together with the filling material, can be advantageously improved through the use or formation of distance pieces between the layers of the venting region. Using distance pieces it is possible, in particular, to avoid any adhesive forces developing between adjacent surfaces of the superimposed layers of the venting region, since such inter-molecular attraction forces obstruct the air flow passing through the venting region. The distance pieces are formed as impressions inserted into at least one of the superimposed layers. By means of such impressions a constructionally simple possibility is created for maintaining such predetermined distances between layers. The impressions may be formed both section-wise and extending over the entire length and width of the venting region on one of the layers.

BRIEF DESCRIPTION OF THE SEVERAL VIEWS OF THE DRAWING(S)

A possible embodiment of the packaging container according to the invention, from which further inventive features may be derived, is shown in the FIGURE.

The only FIGURE shows a perspective view of a packaging container according to the invention which can be vented.

A side-fold sack is marked with 1, which sack comprises a container wall 2 enclosing the filling material. The side-fold sack 1 further comprises a front wall 3, a rear wall 4 as well as two side walls 5, 6 formed as side folds. A venting region 7 with an inner layer 8 and an outer layer 9 is provided in the front wall of sack 1. To implement the venting function the venting region having only one chamber comprises inner openings 10, 10' and at least one outer opening 11. The inner openings 10, 10' are apertures in the inner layer 8 and these are formed in a strip-shaped surface region 12 of the inner layer 8. The surface region 12 extends along the entire height of the venting region 7. The outer opening 11 is formed in one of the joining seams 13, 14 laterally limiting the venting region 7. Inside the venting region 7 a shielding element 15 is formed which is associated with the outer opening 11 in such a way that a deliberate diversion of at least a partial flow of the air flow passing through the venting region 7 is achieved. The shielding element 15 is a seam portion 16 extending parallel to the lateral joining seams 13, 14, wherein the seam portion separates the outer opening 11 from a surface portion 12' arranged directly adjacent to the outer opening, of the strip-shaped surface portion 12 containing the apertures. Both the shielding element 15 and the outer opening 11 are arranged in an end region 17 of the venting region 7, wherein the shielding element 15 directly vertically adjoins a transverse seam 18 limiting the venting region 7 and closing the side-fold sack 1 at the top end. The lower end of the sack 1 is enclosed with the aid of the transverse seam 19. The shielding element 15 has a length of at least 5% and is, at most, 60 percent of the overall height of the venting region 7. The outer opening 11 is formed, in particular, as an interruption of the lateral joining seam 13, wherein the outer layer 9 is fixed to the inner layer 8 by means of the joining seams 13, 14. The side-fold sack 1 may be manufactured from a film web or a tube. With a film web the edge regions thereof are folded so as to produce the inner layer 8 and the outer layer 9 of the venting region 7. With a tube film a separate film strip forming the outer layer is preferably placed on the outside of the film. In order to ensure an undisturbed air flow inside the venting region 7, distance pieces 20, 20' are provided on the outside of the inner layer 8. Alternatively the distance pieces may be formed on the inside of the outer layer 9.

The invention claimed is:

1. A packaging container for bulk materials the packaging container comprising:

a plastic film having at least one container wall enclosing the bulk material;

a multilayer venting region extending in a longitudinal direction of the at least one container and comprising:

at least one inner layer;

one outer layer;

at least one inner opening; and at least one outer opening, wherein the at least one inner opening is formed as an aperture in a strip-shaped surface region of the inner layer of the venting region, wherein the surface region extends over at least one portion in the direction of extent of the venting region, wherein the at least one outer opening is formed in a joining seam laterally limiting the venting region;

exactly one shielding element inside the venting region associated with the outer opening in the joining seam for deliberate diversion of at least a partial flow of the air flow passing through the venting region, wherein the shielding element and the outer opening are arranged in at least an end region of the venting region, wherein the shielding element ends directly at a transverse seam limiting the venting region and separates the inner and outer openings from each other, and wherein the venting region has only one chamber, in which the exactly one shielding element has a length that is between 10% and 50% of the overall length of the venting region and in which the inner layer includes the surface region through which at least further partial flow can pass and which are not in the region of the shielding element, so that the partial flow, which has been diverted at the shielding element, is merged with the at least further partial flow, which has passed through surface portions of the inner layer which are not in the region of the shielding element.

2. The packaging container according to claim 1, wherein the shielding element is a seam portion which separates the outer opening from a directly adjacently arranged surface portion of the strip-shaped surface.

3. The packaging container according to claim 1, wherein the shielding element extends roughly in longitudinal direction of the container.

4. The packaging container according to claim 1, wherein the shielding element is arranged directly adjacently and parallel to the surface region of the strip-shaped surface region comprising the apertures.

5. The packaging container according to claim 1, wherein the outer opening is formed by means of at least one interruption of a lateral joining seam, wherein the superimposed layers of the venting region are connected with each other by means of the joining seam.

6. The packaging container according to claim 1, wherein the outer opening is formed by means of at least one weakened portion of the lateral joining seam.

7. The packaging container according to claim 1, wherein the multilayer venting region between the inner and outer layer is equipped with distance pieces.

* * * * *